US010984718B2

(12) United States Patent
Baik et al.

(10) Patent No.: US 10,984,718 B2
(45) Date of Patent: Apr. 20, 2021

(54) DISPLAY DEVICE AND DRIVING METHOD THEREOF

(71) Applicant: SAMSUNG DISPLAY CO., LTD., Yongin-si (KR)

(72) Inventors: Joon Suk Baik, Yongin-si (KR); Jae Woo Ryu, Yongin-si (KR); Myung Ho Lee, Yongin-si (KR); Sang Su Han, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/541,822

(22) Filed: Aug. 15, 2019

(65) Prior Publication Data

US 2020/0135113 A1 Apr. 30, 2020

(30) Foreign Application Priority Data

Oct. 24, 2018 (KR) ..... 10-2018-0127682

(51) Int. Cl.
*G09G 3/3258* (2016.01)
*G09G 3/20* (2006.01)

(52) U.S. Cl.
CPC ..... *G09G 3/3258* (2013.01); *G09G 3/2007* (2013.01); *G09G 2310/08* (2013.01); *G09G 2320/0233* (2013.01)

(58) Field of Classification Search
CPC ..... G09G 3/3258; G09G 3/2007; G09G 2310/08; G09G 2320/0233
See application file for complete search history.

(56) References Cited

U.S. PATENT DOCUMENTS

| | | | | |
|---|---|---|---|---|
| 8,933,973 | B2 | 1/2015 | Mizukoshi et al. | |
| 2003/0160745 | A1* | 8/2003 | Osame | G09G 3/3233 345/82 |
| 2007/0040792 | A1* | 2/2007 | Kwag | G09G 3/3666 345/100 |
| 2007/0115244 | A1* | 5/2007 | Shin | G09G 3/3266 345/100 |
| 2009/0309868 | A1 | 12/2009 | Jung et al. | |
| 2017/0200416 | A1* | 7/2017 | Kim | G09G 3/3258 |
| 2017/0270864 | A1* | 9/2017 | So | G09G 3/3233 |
| 2018/0197482 | A1* | 7/2018 | Choi | G09G 3/3266 |

FOREIGN PATENT DOCUMENTS

| | | |
|---|---|---|
| KR | 10-1472799 | 12/2014 |
| KR | 10-1647051 | 8/2016 |
| KR | 10-2017-0080331 | 7/2017 |
| KR | 10-2018-0060334 | 6/2018 |

* cited by examiner

*Primary Examiner* — Michael Pervan
(74) *Attorney, Agent, or Firm* — F. Chau & Associates, LLC

(57) ABSTRACT

A display device may include pixels coupled to scan lines and data lines, at least one scan driver for supplying a scan signal to the pixels through the scan lines, and a data driver for supplying a data signal and a bias signal to the pixels through the data lines. The pixels are supplied with the data signal when the scan signal is supplied during display periods, and are supplied with the bias signal when the scan signal is supplied during a bias period between the display periods. By the bias signal, a bias voltage is supplied to first group pixels that emit light with a preset grayscale during the display periods.

20 Claims, 8 Drawing Sheets

DISPLAY DEVICE AND DRIVING METHOD THEREOF

CROSS-REFERENCE TO RELATED APPLICATION

The present application claims priority under 35 U.S.C. § 119(a) to Korean patent application no. 10-2018-0127682, filed on Oct. 24, 2018 in the Korean Intellectual Property Office, the disclosure of which is incorporated by reference herein in its entirety.

TECHNICAL FIELD

Exemplary embodiments of the inventive concept generally relate to a display device and a driving method thereof.

DISCUSSION OF RELATED ART

A display device includes a plurality of pixels arranged in a matrix form at intersection portions of a plurality of data lines, a plurality of scan lines, and a plurality of power lines. Each of the plurality of pixels generally includes an organic light emitting diode and a driving transistor for controlling an amount of current flowing through the organic light emitting diode. Each pixel generates light with a predetermined luminance while supplying current from the driving transistor to the organic light emitting diode, corresponding to a data signal.

Generally, in a pixel, when a white grayscale is expressed after a black grayscale is expressed, light with a luminance lower than a desired luminance is generated during about two frame periods. Therefore, an image with the desired luminance corresponding to a grayscale is not displayed in each of the pixels. As a result, the uniformity of luminance is degraded, which deteriorates the image quality of a moving image.

Degradation of response characteristics of the display device results from characteristics of the driving transistor included in each of the pixels. In other words, a threshold voltage of the driving transistor is shifted corresponding to a voltage applied to the driving transistor during a previous frame period, and light with a luminance required in a current frame period is not generated from the organic light emitting diode due to the shifted threshold voltage.

SUMMARY

According to an exemplary embodiment of the inventive concept, a display device includes pixels coupled to scan lines and data lines, at least one scan driver configured to supply a scan signal to the pixels through the scan lines, and a data driver configured to supply a data signal and a bias signal to the pixels through the data lines. The pixels are supplied with the data signal when the scan signal is supplied during display periods, and are supplied with the bias signal when the scan signal is supplied during a bias period between the display periods, and, by the bias signal, a bias voltage is supplied to first group pixels that emit light with a preset grayscale during the display periods.

By the bias signal, a predetermined voltage may be supplied to second group pixels that do not emit light with the preset grayscale during the display periods.

The predetermined voltage may be a voltage lower than the bias voltage.

The predetermined voltage may be substantially the same voltage as that supplied by the data signal.

The predetermined voltage may be the bias voltage.

The bias signal may be supplied with respect to at least one pixel row selected during the display periods through the data lines when the scan signal is supplied during the bias period.

The display device may further include a timing controller configured to supply image data to the data driver during the display periods and supply bias data to the data driver during the bias period.

The timing controller may select at least one pixel row to which the bias signal is to be supplied during the bias period.

The timing controller may generate and store the bias data, based on the image data supplied to the selected at least one pixel row.

The bias data may be configured such that the bias voltage is supplied to the first group pixels during the bias period.

The timing controller may supply a start signal to the at least one scan driver.

At a start time of the bias period, the timing controller may supply the start signal to a scan driver coupled to the selected at least one pixel row.

At a start time of a reset period after the bias period, the timing controller may supply the start signal to the scan driver coupled to the selected at least one pixel row, and re-supply the image data supplied during the display periods to the data driver.

According to an exemplary embodiment of the inventive concept, a display device includes pixels coupled to scan lines and data lines, at least one scan driver configured to supply a scan signal to the pixels through the scan lines, and a data driver configured to supply a data signal and a bias signal to the pixels through the data lines. The pixels are supplied with the data signal when the scan signal is supplied during display periods, and are supplied with the bias signal when the scan signal is supplied during a bias period between the display periods, and the bias signal is supplied with respect to at least one selected pixel row during the display periods.

The display device may further include a timing controller configured to supply a start signal to the at least one scan driver.

At a start time of the bias period, the timing controller may supply the start signal to a scan driver coupled to the at least one selected pixel row.

By the bias signal, a bias voltage may be supplied to first group pixels that emit light with a preset grayscale during the display periods on the at least one selected pixel row.

By the bias signal, any one of a voltage lower than the bias voltage, the same voltage as that supplied by the data signal, and the bias voltage may be supplied to second group pixels that do not emit light with the preset grayscale during the display periods.

At a start time of a reset period after the bias period, the timing controller may supply the start signal to the scan driver coupled to the at least one selected pixel row, and re-supply image data supplied during the display periods to the data driver.

According to an exemplary embodiment of the inventive concept, a display device includes pixels coupled to scan lines and data lines, first through nth scan drivers configured to supply scan signals to the pixels through the scan lines, a data driver configured to supply data signals and a bias signal to the pixels through the data lines, and a timing controller configured to supply image data and bias data to the data driver, and to sequentially supply first through nth start signals to the first through nth scan drivers, respectively. The pixels are supplied with the data signals when the scan signals are supplied during display periods, and are supplied with the bias signal when the scan signals are supplied during a bias period between the display periods, and n is a natural number greater than one.

BRIEF DESCRIPTION OF THE DRAWINGS

The above and other features of the inventive concept will be more clearly understood by describing in detail exemplary embodiments thereof with reference to the accompanying drawings.

DETAILED DESCRIPTION OF THE EXEMPLARY EMBODIMENTS

Figure 1:
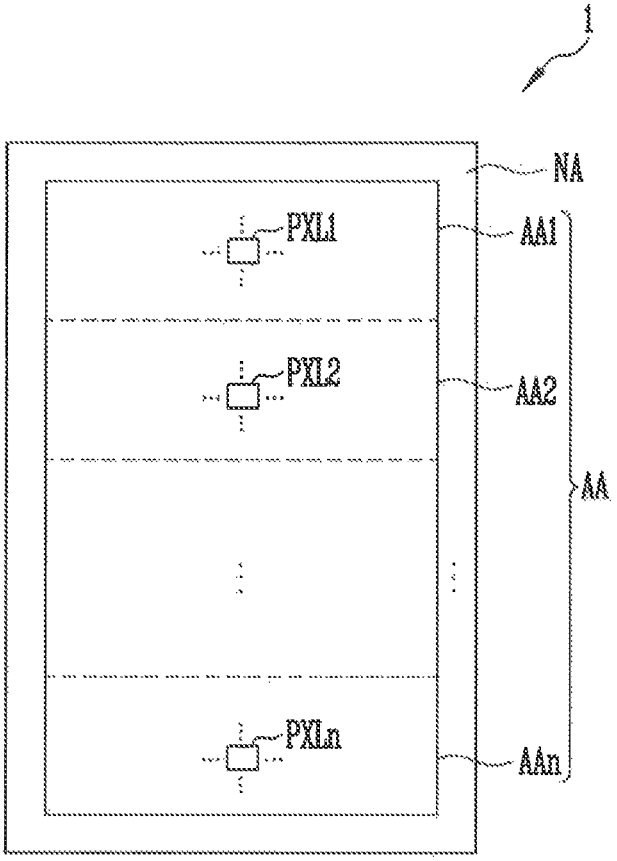
FIG. 1 is a diagram schematically illustrating a display device according to an exemplary embodiment of the inventive concept.

Exemplary embodiments of the inventive concept provide a display device for initializing a threshold voltage characteristic of a driving transistor by applying an on-bias voltage to the driving transistor during a vertical blank period, and a driving method of the display device.

In the entire specification, when an element is referred to as being "connected" or "coupled" to another element, it can be directly connected or coupled to the another element or be indirectly connected or coupled to the another element with one or more intervening elements interposed therebetween. It will also be understood that when an element is referred to as being "between" two elements, it can be the only element between the two elements, or one or more intervening elements may also be present.

Exemplary embodiments of the inventive concept will be described more fully hereinafter with reference to the accompanying drawings. Like reference numerals may refer to like elements throughout this application.

FIG. 1 is a diagram schematically illustrating a display device according to an exemplary embodiment of the inventive concept.

Referring to FIG. 1, a display device 1 includes a display area AA and a peripheral area NA. In exemplary embodiments of the inventive concept, the display area AA may be an active area in which a plurality of pixels PXL1, PXL2, . . . , and PXLn are provided to display an image. In addition, the peripheral area NA may be a remaining area apart from the display area AA, e.g., a non-active area at the periphery of the display area AA.

The display area AA may include at least two pixel areas AA1, AA2, . . . , and AAn arranged adjacent to one another. The plurality of pixels PXL1, PXL2, . . . , and PXLn may be provided in the respective pixel areas AA1, AA2, . . . and AAn. An image may be displayed in the display area AA, using the pixels PXL1, PXL2, . . . , and PXLn.

In exemplary embodiments of the inventive concept, the pixel areas AA1, AA2, . . . and AAn may have the same area or different areas. Alternatively, in exemplary embodiments of the inventive concept, the pixel areas AA1, AA2, . . . and AAn may include the same number of pixel columns or different numbers of pixel columns. In the following exemplary embodiments of the inventive concept, a case where the pixel areas AA1, AA2, . . . and AAn include the same k pixel columns will be described.

The peripheral area NA may be a non-display area in which the image is not displayed. Components for driving the pixels PXL1, PXL2, . . . , and PXLn may be disposed in the peripheral area NA. For example, lines, pads, and/or at least one driver may be disposed in the peripheral area NA.

In exemplary embodiments of the inventive concept, the peripheral area NA may be disposed at the periphery of the display area AA to surround at least a portion of the display area AA. As an example, the peripheral area NA may be disposed to entirely surround the display area AA at the outside of the pixel areas AA1, AA2, . . . , AAn constituting the display area AA.

Figure 2:
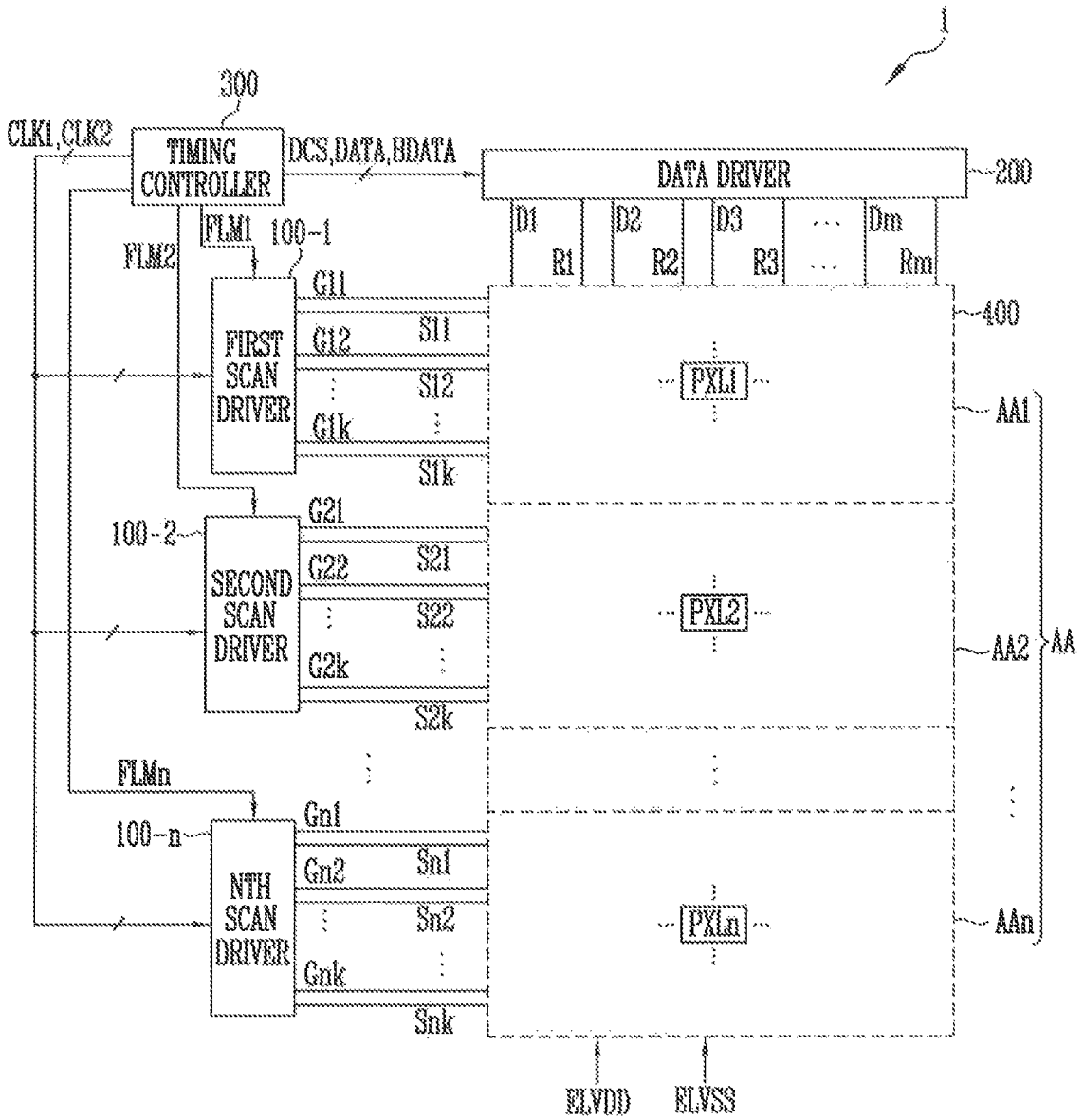
FIG. 2 is a block diagram illustrating a display device according to an exemplary embodiment of the inventive concept.

FIG. 2 is a block diagram illustrating a display device according to an exemplary embodiment of the inventive concept.

Referring to FIG. 2, the display device 1 includes a plurality of scan drivers 100-1, 100-2, 100-3, . . . , and **100-*n*, a data driver 200, a timing controller 300, and a display panel 400**.

The display device 1 may be implemented with an organic light emitting display device, a quantum dot display device, or the like. The display device 1 may be a flat panel display device, a flexible display device, a curved display device, a foldable display device, or a bendable display device. Additionally, the display device 1 may be applied to a transparent display device, a head-mounted display device, a wearable display device, or the like.

The display panel 400 may include the plurality of pixel areas AA1, AA2, . . . , and AAn. Pixels PXL1, PXL2, . . . , and PXLn are disposed in the respective pixel areas AA1, AA2, . . . , and AAn. In an exemplary embodiment of the inventive concept, each of the pixel areas AA1, AA2, . . . , and AAn may include k pixel columns.

The pixels PXL1, PXL2, . . . , and PXLn are coupled to scan lines G11 to G1*k*, G21 to G2*k*, . . . , and Gn1 to Gnk, sensing lines S11 to S1*k*, S21 to S2*k*, . . . , and Sn1 to Snk, data lines D1 to Dm, and read-out lines R1 to Rm. In exemplary embodiments of the inventive concept, the scan lines G11 to G1*k*, G21 to G2*k*, . . . , and Gn1 to Gnk and the sensing lines S11 to S1*k*, S21 to S2*k*, . . . , and Sn1 to Snk may be provided to the display panel 400 in a shape extending along a first direction, e.g., a horizontal direction. In exemplary embodiments of the inventive concept, the data lines D1 to Dm may be provided to the display panel 400 in a shape extending along a second direction, e.g., a vertical direction, which intersects the scan lines G11 to G1*k*, G21 to G2*k*, . . . , and Gn1 to Gnk and the sensing lines S11 to S1*k*, S21 to S2*k*, . . . , and Sn1 to Snk.

The pixels PXL1, PXL2, . . . , and PXLn are selected in units of horizontal lines when a scan signal is supplied to the scan lines G11 to G1k, G21 to G2k, . . . , and Gn1 to Gnk, to be supplied with a data signal or bias signal from the data lines D1 to Dm.

Meanwhile, in an exemplary embodiment of the inventive concept, the pixels PXL1, PXL2, . . . , and PXLn may be implemented with various types of circuits known in the art. For example, the pixels PXL1, PXL2, . . . , and PXLn may include various pixel circuits including a driving transistor. In addition, the number of the scan lines G11 to G1k, G21 to G2k, . . . , and Gn1 to Gnk and the sensing lines S11 to S1k, S21 to S2k, . . . , and Sn1 to Snk may be variously modified.

The timing controller 300 generates clock signals CLK1 and CLK2, start signals FLM1, FLM2, . . . , and FLMn, and a data control signal DCS, corresponding to synchronization signals supplied from the outside. The clock signals CLK1 and CLK2 generated by the timing controller 300 are supplied to the scan drivers 100-1, 100-2, 100-3, . . . , and 100*n*. The start signals FLM1, FLM2, . . . , and FLMn generated by the timing controller 300 are supplied to the respective scan drivers 100-1, 100-2, 100-3, . . . , and 100-*n*. The data control signal DCS generated by the timing controller 300 is supplied to the data driver 200.

The start signals FLM1, FLM2, . . . , and FLMn control supply timings of scan signals from the respective scan drivers 100-1, 100-2, 100-3, . . . , and 100-*n*. In addition, the clock signals CLK1 and CLK2 are used to shift the start signals FLM1, FLM2, . . . , and FLMn.

A source start signal, a source output enable signal, a source sampling clock, or the like are included in the data control signal DCS. The source start signal controls a data sampling start time of the data driver 200. The source sampling clock may be used to control a sampling operation of the data driver 200. The source output enable signal controls an output timing of the data driver 200.

In exemplary embodiments of the inventive concept, the timing controller 300 may supply image data DATA to the data driver 200 during a display period in one frame. The timing controller 300 may generate bias data BDATA to be supplied to the data driver 200 during a vertical blank period provided between the display periods, based on the image data DATA supplied to the data driver 200 during the display period.

By the image data DATA supplied during the display period, on the same pixel column, some pixels (hereinafter, referred to as first group pixels) among the pixels PXL1, PXL2, . . . , and PXLn may emit light with a grayscale no more than (or less than) a preset threshold grayscale, or a black grayscale, and the other pixels (hereinafter, referred to as second group pixels) among the pixels PXL1, PXL2, . . . , and PXLn may emit light with a grayscale exceeding (or no less than) the preset threshold grayscale, or a grayscale that is not the black grayscale.

The bias data BDATA may be configured such that a bias voltage is applied to the first group pixels. The bias voltage is applied to the first group pixels during the vertical blank period.

In an exemplary embodiment of the inventive concept, the timing controller 300 may store the generated bias data BDATA in the timing controller 300 or in a memory separately provided in the outside, and load the bias data BDATA stored in the memory during a bias period in the vertical blank period and then provide the loaded bias data BDATA to the data driver 200. In exemplary embodiments of the inventive concept, the timing controller 300 may store, in the memory, image data DATA supplied to the pixels PXL1, PXL2, . . . , and PXLn during a corresponding frame. The timing controller 300 may load image data DATA stored during a reset period in the vertical blank period and then provide the loaded image data DATA to the data driver 200.

The data driver 200 may be supplied with the data control signal DCS from the timing controller 300. The data driver 200 supplied with the data control signal DCS may supply a data signal and a bias signal to the data lines D1 to Dm. The data signal supplied to the data lines D1 to Dm may be supplied to the data lines D1 to Dm to be synchronized with the scan signal during the display period. The bias voltage supplied to the data lines D1 to Dm may be supplied to the data lines D1 to Dm to be synchronized with the scan signal during the vertical blank period provided between the display periods.

The scan drivers 100-1, 100-2, 100-3, . . . , and 100-*n* may receive the clock signals CLK1 and CLK2 and the start signals FLM1, FLM2, . . . , and FLMn from the timing controller 300. The scan drivers 100-1, 100-2, 100-3, . . . , and 100-*n* supply the scan signal to the scan lines G11 to G1k, G21 to G2k, . . . , and Gn1 to Gnk, corresponding to the clock signals CLK1 and CLK2 and the start signals FLM1, FLM2, . . . , and FLMn.

For example, a first scan driver 100-1 sequentially supplies the scan signal to first scan lines G11 to G1k coupled to pixels PXL1 of a first pixel area AA1 in response to a first start signal FLM1 received from the timing controller 300. In addition, a second scan driver 100-2 sequentially supplies the scan signal to second scan lines G21 to G2k coupled to pixels PXL2 of a second pixel area AA2 in response to a second start signal FLM2 received from the timing controller 300. Similarly, an nth scan driver 100-*n* sequentially supplies the scan signal to nth scan lines Gn1 to Gnk coupled to pixels PXLn of an nth pixel area AAn in response to an nth start signal FLMn received from the timing controller 300.

When the scan signal is sequentially supplied to the scan lines G11 to G1k, G21 to G2k, . . . , and Gn1 to Gnk, the pixels PXL1, PXL2, . . . , and PXLn may be selected in units of horizontal lines, to be supplied with the data signal or the bias signal.

In an exemplary embodiment of the inventive concept, the scan drivers 100-1, 100-2, 100-3, . . . , and 100-*n* may supply a sensing signal to the sensing lines S11 to S1k, S21 to S2k, . . . , and Sn1 to Snk, corresponding to the clock signals CLK1 and CLK2 and the start signals FLM1, FLM2, . . . , and FLMn.

The scan signal and the sensing signal may be set to a gate-on voltage (e.g., a logic high level) at which transistors included in the pixels PXL1, PXL2, . . . , and PXLn can be turned on. The gate-on voltage does not refer to one fixed voltage value but may refer to a voltage that allows the transistors supplied with the gate-on voltage to be turned on.

Figure 3:
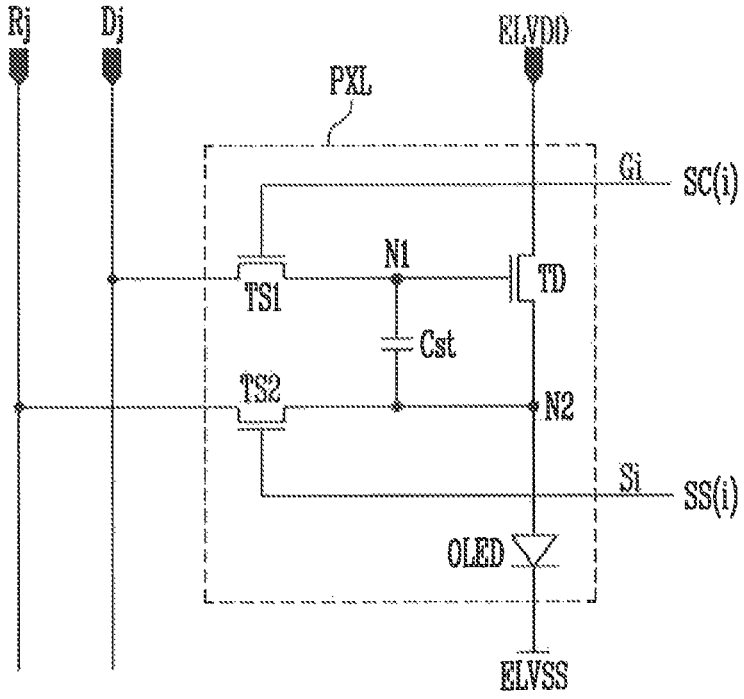
FIG. 3 illustrates a pixel shown in FIG. 2 according to an exemplary embodiment of the inventive concept.

FIG. 3 illustrates a pixel shown in FIG. 2 according to an exemplary embodiment of the inventive concept.

A pixel PXL of FIG. 3 may receive an ith scan signal SC(i) through an ith scan line Gi, and receive an ith sensing signal SS(i) through an ith sensing line Si. Additionally, the pixel PXL of FIG. 3 may be disposed on an ith pixel row and a jth pixel column. A jth data line Dj and a jth read-out line Rj may be coupled to the pixel PXL.

Referring to FIG. 3, the pixel PXL may include an organic light emitting diode OLED, a driving transistor TD, a first switching transistor TS1, a second switching transistor TS2, and a storage capacitor Cst.

An anode electrode of the organic light emitting diode OLED may be coupled to a second electrode of the driving transistor TD, and a cathode electrode of the organic light emitting diode OLED may be coupled to a second driving power source ELVSS. The organic light emitting diode OLED generates light with a predetermined luminance corresponding to an amount of current supplied from the driving transistor TD.

A first electrode of the driving transistor TD may be coupled to a first driving power source ELVDD, and the second electrode of the driving transistor TD may be coupled to the anode electrode of the organic light emitting diode OLED. A gate electrode of the driving transistor TD may be coupled to a first node N1. The driving transistor TD controls an amount of current flowing to the organic light emitting diode OLED, corresponding to a voltage of the first node N1.

A first electrode of the first switching transistor TS1 may be coupled to the jth data line Dj, and a second electrode of the first switching transistor TS1 may be coupled to the first node N1. A gate electrode of the first switching transistor TS1 may be coupled to the ith scan line Gi. Referring to FIG. 3, the first switching transistor TS1 may be turned on when the ith scan signal SC(i) is supplied to the ith scan line Gi. The first switching transistor TS1 is turned on, to transfer a voltage from the jth data line Dj to the first node N1.

When the first switching transistor TS1 is turned on, a signal supplied to the jth data line Dj may be transferred to the first node N1. In exemplary embodiments of the inventive concept, when the first switching transistor TS1 is turned on in response to the ith scan signal SC(i) during the display period, a data signal supplied to the jth data line Dj may be transferred to the first node N1.

In an exemplary embodiment of the inventive concept, the data signal for displaying an image corresponding to the pixel PXL may be applied to the jth data line Dj during a display period DP. By the data signal supplied to the corresponding pixel PXL during the display period DP, when the corresponding pixel PXL is included in a first group, a bias signal may be applied to the jth data line Dj during a bias period in a vertical blank period. In the present exemplary embodiment, when the first switching transistor TS1 is turned on in response to the ith scan signal SC(i) during the bias period in the vertical blank period, the bias signal supplied to the jth data line Dj may be transferred to the first node N1. In an exemplary embodiment of the inventive concept, when the first switching transistor TS1 is turned on in response to the ith scan signal SC(i) during a reset period in the vertical blank period, the data signal supplied to the jth data line Dj may be transferred to the first node N1.

The second switching transistor TS2 may be coupled between the jth read-out line Rj and the first electrode (e.g., the first node N1) of the driving transistor TD. The second switching transistor TS2 may be turned on when the ith sensing signal SS(i) is supplied to the ith sensing line Si. The second switching transistor TS2 is turned on, to transfer a voltage from the jth read-out line Rj to a second node Dn.

In an exemplary embodiment of the inventive concept, when the second switching transistor TS2 is turned on in response to the ith sensing signal SS(i) during the display period, an initialization voltage supplied to the jth read-out line Rj may be transferred to the second node Dn. In addition, when the second switching transistor TS2 is turned on in response to the ith sensing signal SS(i) during the vertical blank period, a reference voltage supplied to the jth read-out line Rj may be transferred to the second node Dn. The reference voltage may be an arbitrary voltage preset to apply the bias voltage to the driving transistor TD. In exemplary embodiments of the inventive concept, the reference voltage may be an arbitrary voltage preset to sense an electrical characteristic of the driving transistor TD and/or the organic light emitting diode OLED.

The storage capacitor Cst may be coupled between the first node N1 and the anode electrode of the organic light emitting diode OLED. The storage capacitor Cst stores a voltage corresponding to the difference in voltage between the first node N1 and the second node Dn. In an exemplary embodiment of the inventive concept, when the data signal is applied to the first node N1 and the initialization voltage is applied to the second node Dn during the display period, the storage capacitor Cst may store a voltage corresponding to the difference between the data voltage and the initialization voltage. In an exemplary embodiment of the inventive concept, when the bias signal is applied to the first node N1 and the reference voltage is applied to the second node Dn during the bias period, the storage capacitor Cst may store a signal corresponding to the difference between the bias voltage and the reference voltage. In an exemplary embodiment of the inventive concept, when the data signal is applied to the first node N1 and the reference voltage is applied to the second node Dn during the reset period, the storage capacitor Cst may store a signal corresponding to the difference between the data signal and the reference voltage.

Figure 4:
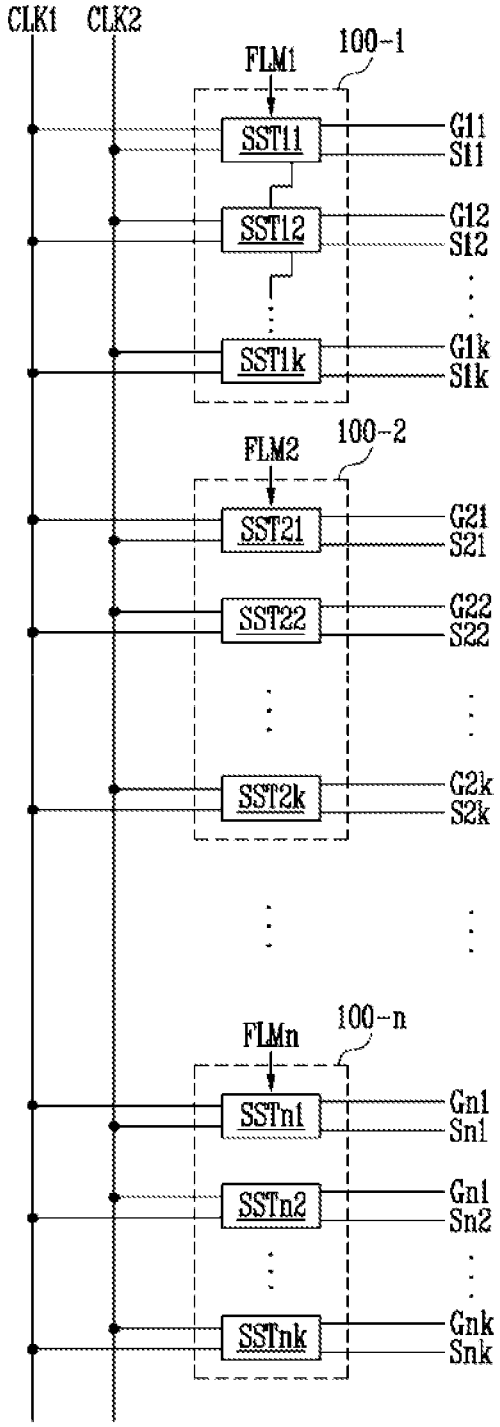
FIG. 4 illustrates scan drivers shown in FIG. 2 according to an exemplary embodiment of the inventive concept.

FIG. 4 illustrates an exemplary embodiment of the scan drivers shown in FIG. 2. Although an exemplary embodiment in which the scan drivers are driven by two clock signals is illustrated in FIG. 4, the inventive concept is not limited thereto. In other words, the number and/or kind of clock signals may be modified.

Referring to FIG. 4, the first scan driver 100-1 according to an exemplary embodiment of the inventive concept includes first scan stages SST11 to SST1*k* respectively coupled to the first scan lines G11 to G1*k* and first sensing lines S11 to S1*k*. In exemplary embodiments of the inventive concept, the number of the first scan stages SST11 to SST1*k* may be variously modified depending on the number of horizontal lines provided in the first pixel area AA1.

The first scan stages SST11 to SST1*k* are supplied with the first start signal FLM1 and the clock signals CLK1 and CLK2, and sequentially supply a first scan signal to the first scan lines G11 to G1*k* and sequentially supply a first sensing signal to the first sensing lines S11 to S1*k*, corresponding to the first start signal FLM1. For example, a first scan stage SST11 may supply the first scan signal to a first scan line G11 and supply the first sensing signal to a first sensing line S11, corresponding to the first start signal FLM1. In addition, each of the other first scan stages SST12 to SST1*k* may supply the first scan signal and the first sensing signal to a first scan line (any one of G12 to G1*k*) coupled thereto, corresponding to an output signal of a previous stage (e.g., a scan signal of the previous stage). In other words, supply times of the first signals respectively supplied to the first scan lines G11 to G1*k* may be determined corresponding to a supply time of the first start signal FLM1.

In exemplary embodiments of the inventive concept, the second scan driver 100-2 includes second scan stages SST21 to SST2*n* respectively coupled to the second scan lines G21 to G2*k* and second sensing lines S21 to S2*k*. The second scan stages SST21 to SST2*n* are supplied with the second start signal FLM2 and the clock signals CLK1 and CLK2, and sequentially supply a second scan signal to the second scan lines G21 to G2*k* and sequentially supply a second sensing signal to the second sensing lines S21 to S2*k*, corresponding to the second start signal FLM2. For example, a first second scan stage SST21 may supply the second scan signal to a first second scan line G21 and supply the second sensing signal to a first second sensing line S21, corresponding to the second start signal FLM2. In an exemplary embodiment of the inventive concept, a supply time of the second start signal FLM2 may be synchronized with a scan signal output time of the last scan stage SST1*k* of the first scan driver 100-1.

Scan stages of the other scan drivers operate substantially identically to the configuration described above, and therefore, their individual descriptions will be omitted.

Meanwhile, in an exemplary embodiment of the inventive concept, the configuration of the scan stages SST11 to SST1*k*, SST21 to SST2*k*, . . . , and SSTn1 to SSTnk is not particularly limited. In other words, the scan stages SST11 to SST1*k*, SST21 to SST2*k*, . . . , and SSTn1 to SSTnk may be implemented with various types of scan driving circuits currently known in the art.

Figure 5:
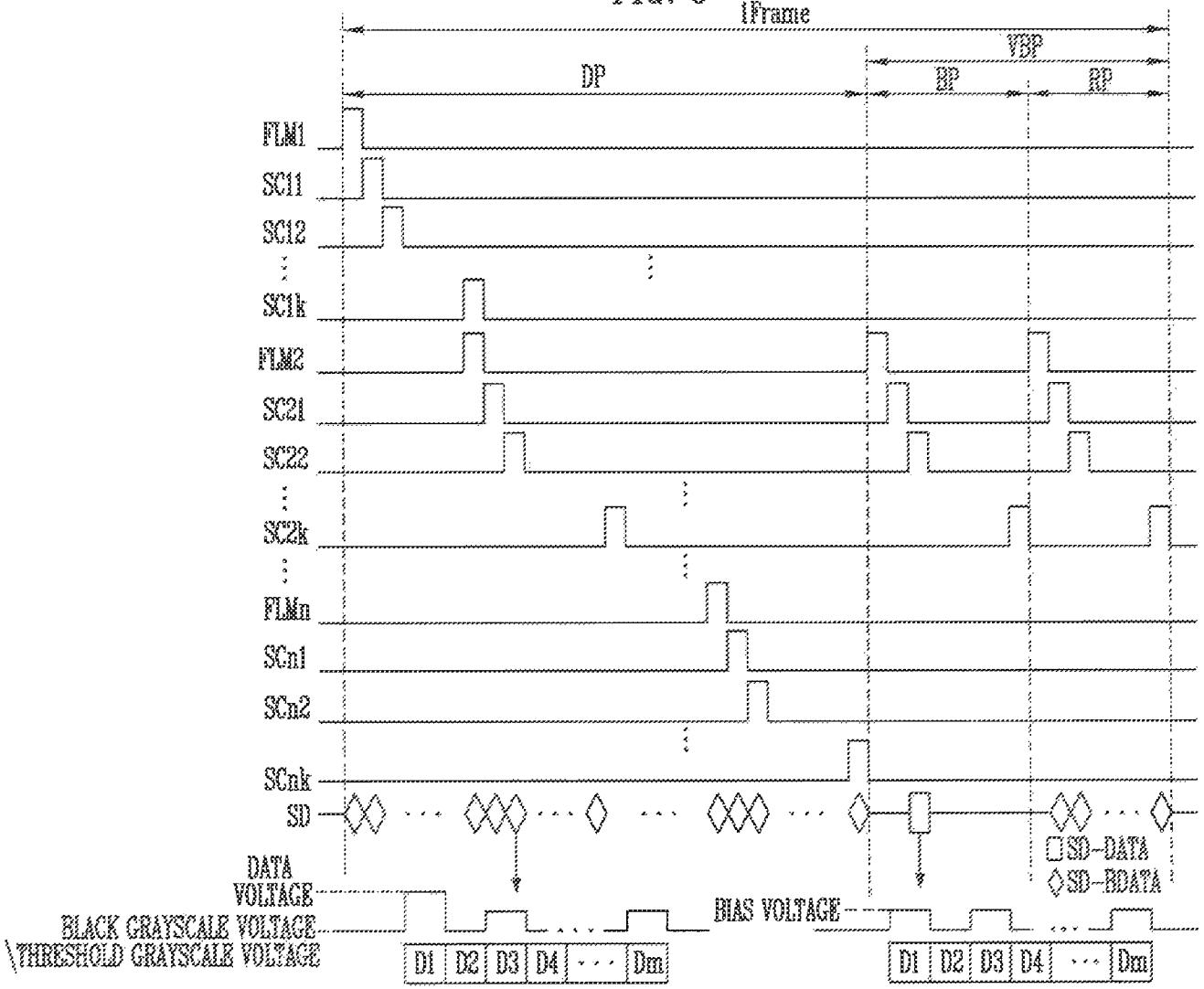
FIG. 5 is a timing diagram illustrating a driving method of a display device according to an exemplary embodiment of the inventive concept.

FIG. 5 is a timing diagram illustrating a driving method of a display device according to an exemplary embodiment of the inventive concept.

Referring to FIGS. 1 to 5, one frame period may include the display period DP and a vertical blank period VBP. The vertical blank period VBP may include a bias period BP and a reset period RP.

Referring to FIG. 5, during the display period DP, the timing controller 300 supplies the first start signal FLM1 to the first scan driver 100-1, supplies the second start signal FLM2 to the second scan driver 100-2, and supplies the nth start signal FLMn to the nth scan driver **100-*n***.

Supply timings of the first start signal FLM1, the second start signal FLM2, and the nth start signal FLMn are set such that a first scan signal SC1, a second scan signal SC2, and a kth scan signal SCk are sequentially supplied to the first scan lines G11 to G1*k*, the second scan lines G21 to G2*k*, and the nth scan lines Gn1 to Gnk. In other words, the second start signal FLM2 is synchronized with a scan signal SC1*k* output from the last stage STT1*k* of the first scan driver 100-1, and the nth start signal FLMn is synchronized with a scan signal SCn−1k output from the last stage STTn−1k of an (n−1)th scan driver **100-*n*−1**.

When the first start signal FLM1 is supplied, the first scan driver 100-1 supplies a first scan signal SC11 to the first scan line G11 (FIG. 4), corresponding to the clock signals CLK1 and CLK2 (FIG. 2). As an example, the first scan driver 100-1 shifts the first start signal FLM1, corresponding to the clock signals CLK1 and CLK2, so that the first scan signal SC11 can be supplied to the first scan line G11. Additionally, the first scan driver 100-1 shifts the first scan signal SC11, so that a second first scan signal SC12 can be supplied to a second first scan line G12. In the above-described manner, the first scan driver 100-1 sequentially supplies the first scan signal SC1 to the first scan lines G11 to G1*k*. Then, a data signal SD-DATA from the data driver 200 is supplied to the first pixel area AA1. Accordingly, a predetermined image corresponding to the data signal SD-DATA is displayed in the first pixel area AA1.

When the second start signal FLM2 is supplied, the second scan driver 100-2 supplies a first second scan signal SC21 to the first second scan line G21, corresponding to the clock signals CLK1 and CLK2. As an example, the second scan driver 100-2 shifts the second start signal FLM2, corresponding to the clock signals CLK1 and CLK2, so that the first second scan signal SC21 can be supplied to the first second scan line G21. Additionally, the second scan driver 100-2 shifts the first second scan signal SC21, so that a second scan signal SC22 can be supplied to a second scan line G22. In the above-described manner, the second scan driver 100-2 sequentially supplies the second scan signal SC2 to the second scan lines G21 to G2*n*. Then, the data signal SD-DATA from the data driver 200 is supplied to the second pixel area AA2, and accordingly, a predetermined image corresponding to the data signal SD-DATA is displayed in the second pixel area AA2.

Since the nth scan driver **100-*n*** also operates in substantially the same manner as described above, a detailed description will be omitted.

When a data signal having a grayscale no more than (or less than) a black or arbitrary grayscale is supplied during the display period DP, a corresponding pixel is driven corresponding to a black or low grayscale. A threshold voltage of the driving transistor included in the corresponding pixel is shifted corresponding to the black or low grayscale, and accordingly, a desired grayscale may not be implemented during a next frame period.

Thus, according to an exemplary embodiment of the inventive concept, when a data signal having a grayscale no more than (or less than) a black or arbitrary grayscale is supplied during the display period DP, a data signal corresponding to an on-bias is supplied to a corresponding pixel, so that a threshold voltage of the driving transistor included in the corresponding pixel is shifted corresponding to the on-bias. When the threshold voltage of the corresponding pixel is shifted corresponding to the on-bias, a desired grayscale can be implemented during the next frame period.

Hereinafter, the above-described operation of the inventive concept will be described in more detail.

During the display period DP, the timing controller 300 may select a pixel row on which a bias is to be performed in a corresponding frame. The pixel row may be sequentially or randomly selected for every frame. Alternatively, the pixel row may be determined based on the data signal SD-DATA in the corresponding frame. For example, the pixel row may be selected based on the number of first group pixels in the corresponding frame. Alternatively, for example, the pixel row may be selected based on whether an average of data voltages supplied by the data signal SD-DATA corresponds to no more than (or less than) a preset threshold grayscale. However, the inventive concept is not limited thereto. A plurality of pixel rows on which the bias is to be performed may be selected in one frame. This exemplary embodiment will be described below with reference to FIG. 6.

During the display period DP, the timing controller 300 may generate bias data BDATA with respect to the selected pixel row. In an exemplary embodiment of the inventive concept, the timing controller 300 may generate the bias data BDATA, based on the image data DATA supplied to the selected pixel row in the corresponding frame.

For example, on the selected pixel row, the timing controller 300 may generate the bias data BDATA that allows a bias voltage to be applied to first group pixels. Alternatively, on the selected pixel row, the timing controller 300 may generate the bias data BDATA that allows the bias voltage to be applied to the first group pixels and allows a voltage, e.g., 0 V, lower than the bias voltage to be applied to second group pixels.

In an exemplary embodiment of the inventive concept, on the selected pixel row, the timing controller 300 may generate the bias data BDATA that allows the bias voltage to be applied to the first group pixels and allows a voltage corresponding to the data signal of the corresponding frame to be applied to the second group pixels. This exemplary embodiment will be described below with reference to FIG. 7.

Alternatively, the timing controller 300 may generate the bias data BDATA that allows the bias voltage to be applied to all pixels PXL on the selected pixel row. This exemplary embodiment will be described below with reference to FIG. 8.

At a start time of the vertical blank period VBP, e.g., a start time of the bias period BP, the timing controller 300 may supply a corresponding one of the start signals FLM1, FLM2, . . . , and FLMn to a corresponding one of the scan drivers 100-1, 100-2, 100-3, . . . , and 100-*n* coupled to the selected pixel row through a corresponding one of the scan lines G11 to G1*k*, G21 to G2*k*, . . . , and Gn1 to Gnk.

Additionally, the timing controller 300 may supply the bias data BDATA generated during the bias period BP to the data driver 200. During the bias period BP, a bias signal SD-BDATA is supplied to the data lines D1 to Dm to be synchronized with a scan signal SC supplied to the selected pixel row. A supply time of the bias signal SD-BDATA may be controlled by a supply time of the bias data BDATA to the data driver 200 and a control signal.

A voltage may be applied to the pixels PXL on the selected pixel row by the bias signal SD-BDATA. In particular, the bias voltage may be applied to the first group pixels of the corresponding frame on the selected pixel row. In the exemplary embodiment of FIG. 5, a voltage, e.g., 0V, lower than the bias voltage may be applied to the second group pixels of the corresponding frame on the selected pixel row.

Figure 7:
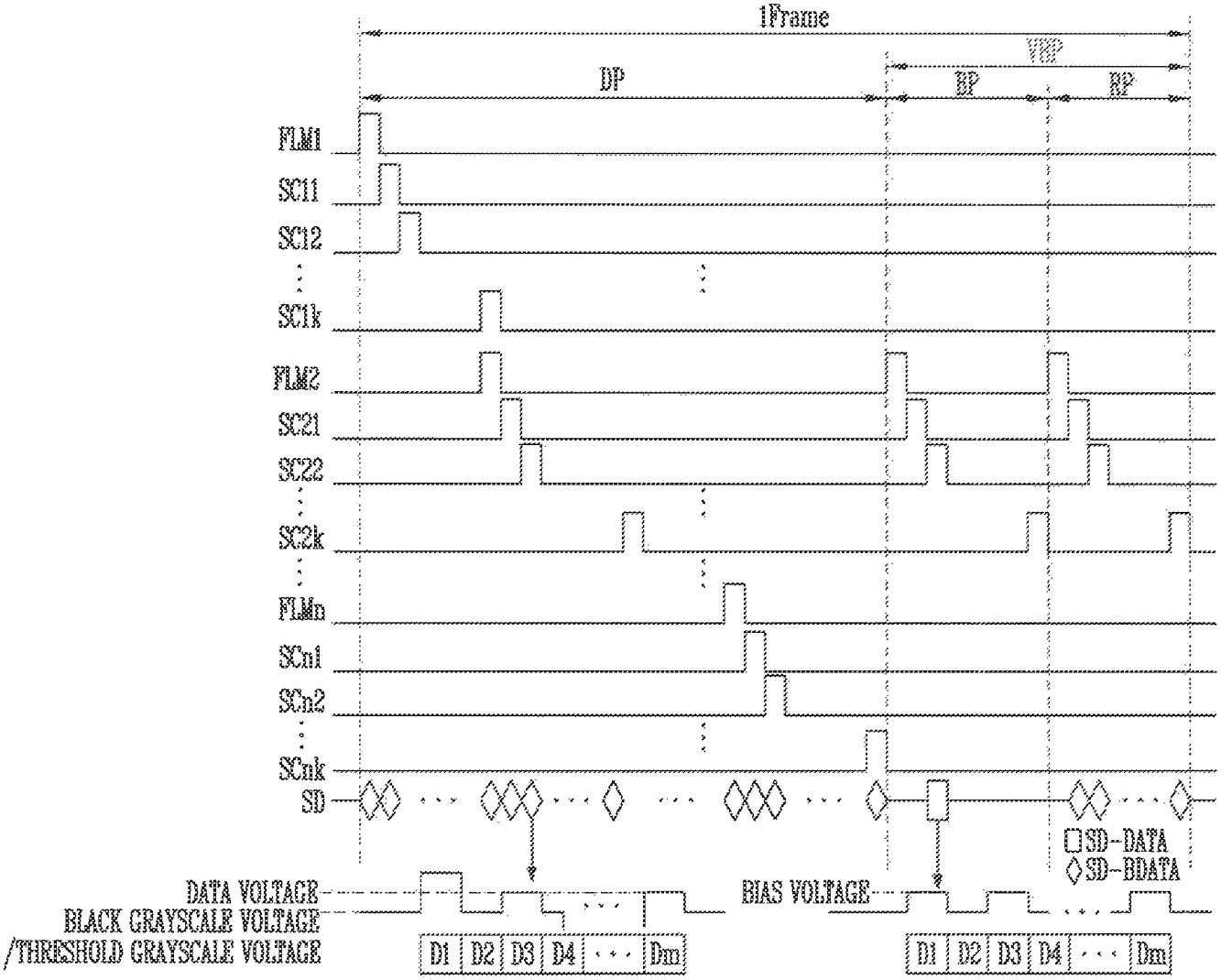
FIG. 7 is a timing diagram illustrating a driving method of a display device according to an exemplary embodiment of the inventive concept.
Figure 8:
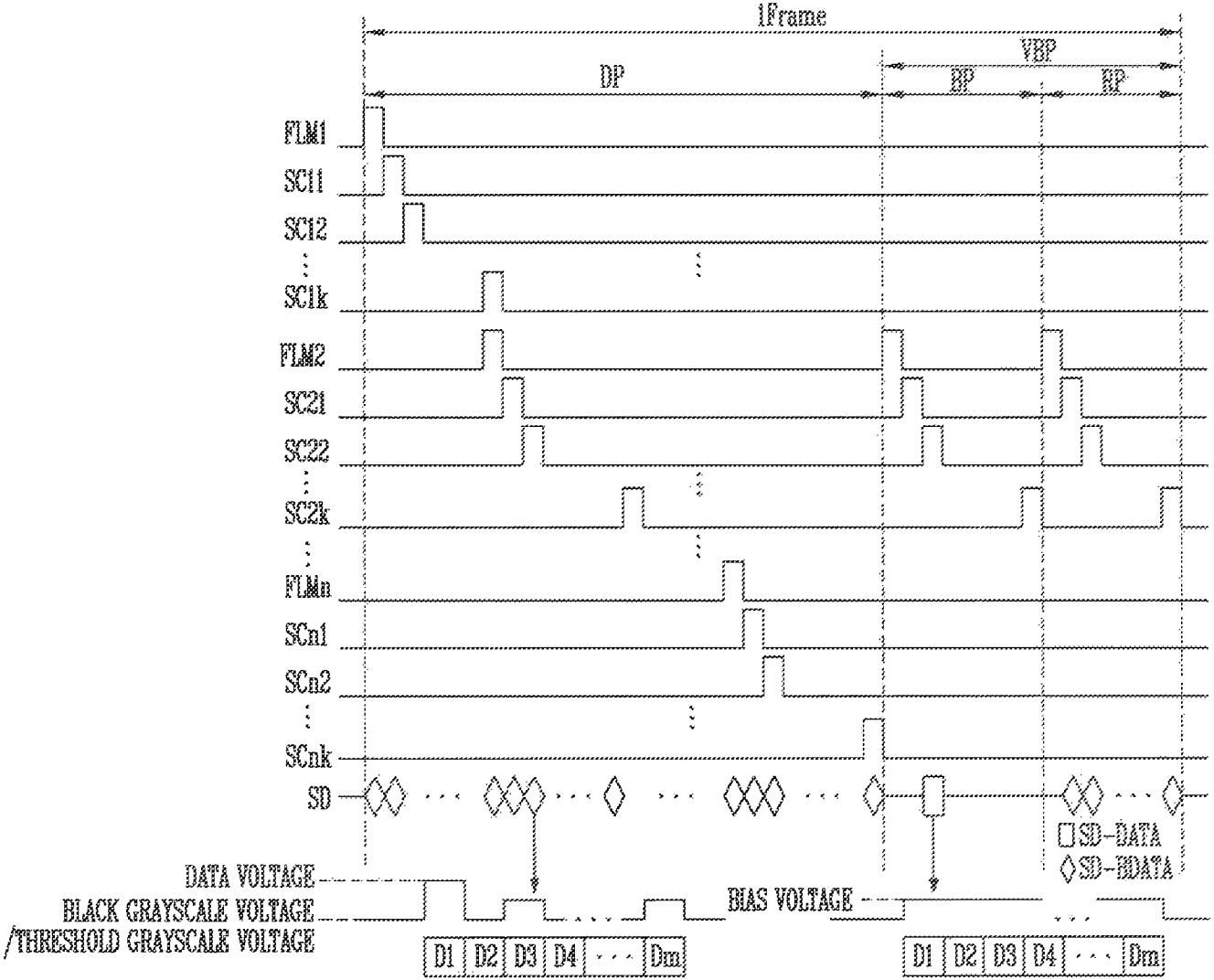
FIG. 8 is a timing diagram illustrating a driving method of a display device according to an exemplary embodiment of the inventive concept.

However, in an exemplary embodiment of the inventive concept, a voltage corresponding to the data signal SD-DATA of the corresponding frame may be applied to the second group pixels of the corresponding frame. This exemplary embodiment is illustrated in FIG. 7. Meanwhile, in an exemplary embodiment of the inventive concept, the bias voltage may also be applied to the second group pixels. This exemplary embodiment is illustrated in FIG. 8.

FIG. 5 illustrates an example in which a pixel row coupled to a second scan stage SST22 of the second scan driver 100-2 through the second scan line G22 is selected as a pixel row on which the bias is to be performed during the display period DP. Pixels PXL coupled to a second data line D2 and a fourth data line D4 on the corresponding pixel row constitute a first group, and pixels PXL coupled to a first data line D1, a third data line D3, and an mth data line Dm constitute a second group.

At the start time of the vertical blank period VBP, the timing controller 300 may supply the second start signal FLM2 to the second scan driver 100-2. When the second start signal FLM2 is supplied, the second scan stages SST21 to SST2*n* sequentially supply second scan signals SC21 to SC2*k* to the second scan lines G21 to G2*k*.

Additionally, the timing controller 300 supplies the bias data BDATA to the data driver 200 during the bias period BP. When a second scan signal SC22 is output to the selected pixel row, the data signal SD-BDATA from the bias data BDATA is supplied to the data lines D1 to Dm to be synchronized with the second scan signal SC22. Accordingly, the bias voltage can be supplied to the first group pixels during the vertical blank period VBP.

During the display period DP and the vertical blank period VBP, a sensing signal SS may be supplied to the sensing lines S11 to S1*k*, S21 to S2*k*, . . . , and Sn1 to Snk to be synchronized with a scan signal SC.

Subsequently, at a start time of the reset period RP, the timing controller 300 may supply a corresponding one of the start signals FLM1, FLM2, . . . , and FLMn to a corresponding one of the scan drivers 100-1, 100-2, 100-3, . . . , and 100-*n* coupled to the selected pixel row through a corresponding one of the scan lines G11 to G1*k*, G21 to G2*k*, . . . , and Gn1 to Gnk. Additionally, the timing controller 300 may supply the image data DATA stored during the display period DP to the data driver 200. Thus, the same data signal SD-DATA as that supplied to the pixels PXL on the selected pixel row during the display period DP is supplied to the data lines D1 to Dm to be synchronized with the scan signal SC.

Each of the pixels PXL is reset to a state before the bias by the data signal SD-DATA supplied during the reset period RP, and a desired image can be displayed during a next frame period without influence caused by the bias.

Figure 6:
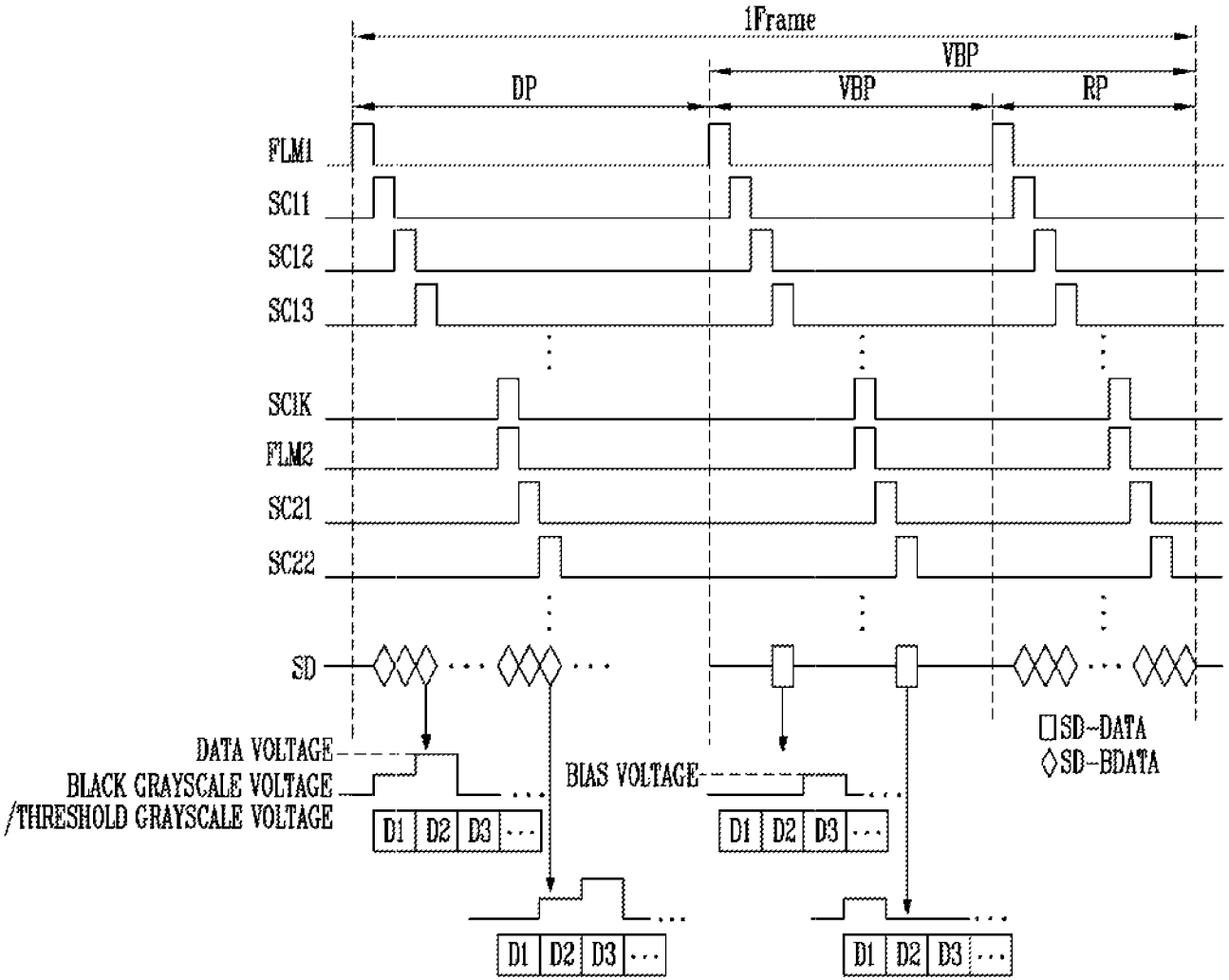
FIG. 6 is a timing diagram illustrating a driving method of a display device according to an exemplary embodiment of the inventive concept.

FIG. 6 is a timing diagram illustrating a driving method of a display device according to an exemplary embodiment of the inventive concept.

In the exemplary embodiment of FIG. 6, as compared with FIG. 5, a plurality of pixel rows are selected as pixel rows on which the bias is to be performed during the display period DP. Accordingly, the timing controller 300 can generate the bias data BDATA respectively with respect to the plurality of pixel rows during the display period DP.

FIG. 6 illustrates an example in which a pixel row coupled to a third first scan stage SST13 of the first scan driver 100-1 through a third first scan line G13 and a pixel row coupled to the second scan stage SST22 of the second scan driver 100-2 through the second scan line G22 are selected as pixel rows on which the bias is to be performed during the display period DP.

At a start time of the bias period BP, the timing controller 300 may supply the start signals FLM1 and FLM2 to the scan drivers 100-1 and 100-2 coupled to the plurality of selected pixel rows through the scan lines G13 and G22.

Additionally, the timing controller 300 supplies the bias data BDATA to the data driver during the bias period BP. When a third first scan signal SC13 and the second scan signal SC22 are respectively output to the selected pixel rows, the data signal SD-BDATA from the bias data BDATA is supplied to the data lines D1 to Dm to be synchronized with the scan signals. A bias voltage may be supplied to a specific pixel PXL, based on the data signal SD-BDATA.

FIG. 7 is a timing diagram illustrating a driving method of a display device according to an exemplary embodiment of the inventive concept.

In the exemplary embodiment of FIG. 7, as shown in FIG. 5, during the bias period BP, a bias voltage is applied to the first group pixels, and the same voltage as that caused by a data signal of a corresponding frame is applied to the second group pixels. The timing controller 300 may generate the bias data BDATA with respect to the other pixels with reference to the image data DATA supplied to the pixel rows during the display period DP.

FIG. 8 is a timing diagram illustrating a driving method of a display device according to an exemplary embodiment of the inventive concept.

In the exemplary embodiment of FIG. 8, as compared with FIG. 5, during the bias period BP, a bias voltage is applied to all pixels PXL of a selected pixel row. In other words, when the bias data BDATA with respect to the selected pixel row is generated during the display period DP, the timing controller 300 may generate the bias data BDATA such that the bias voltage is applied to both the first group pixels and the second group pixels.

According to the present exemplary embodiment, threshold voltage characteristics of all pixels PXL included in the pixel row can be initialized.

As described above, in the display device and the driving method thereof according to exemplary embodiments of the inventive concept, a shifted threshold voltage of the driving transistor is compensated, so that an image with a uniform luminance can be displayed.

While the inventive concept has been shown and described with reference to exemplary embodiments thereof, those of ordinary skill in the art will readily appreciate that modifications in form and details may be made thereto without materially departing from spirit and scope of the inventive concept as set forth by the following claims.

What is claimed is:

1. A display device comprising:

pixels coupled to scan lines and data lines;

at least one scan driver configured to supply a scan signal to the pixels through the scan lines; and a data driver configured to supply a data signal and a bias signal to the pixels through the data lines, wherein the pixels are supplied with the data signal when the scan signal is supplied during display periods, and are supplied with the bias signal when the scan signal is supplied during a bias period between the display periods, and wherein, by the bias signal, a bias voltage is supplied to first group pixels that emit light with no more or less than a preset grayscale, or a black grayscale, during the display periods, the first group pixels corresponding to at least one pixel column.

2. The display device of claim 1, wherein, by the bias signal, a predetermined voltage is supplied to second group pixels that do not emit light with exceeding or no less than the preset grayscale, or a grayscale that is not the black grayscale, during the display periods.

3. The display device of claim 2, wherein the predetermined voltage is a voltage lower than the bias voltage.

4. The display device of claim 2, wherein the predetermined voltage is substantially the same voltage as that supplied by the data signal.

5. The display device of claim 2, wherein the predetermined voltage is the bias voltage.

6. The display device of claim 1, wherein the bias signal is supplied with respect to at least one pixel row selected during the display periods through the data lines when the scan signal is supplied during the bias period.

7. The display device of claim 1, further comprising a timing controller configured to supply image data to the data driver during the display periods and supply bias data to the data driver during the bias period.

8. The display device of claim 7, wherein the timing controller selects at least one pixel row to which the bias signal is to be supplied during the bias period.

9. The display device of claim 8, wherein the timing controller generates and stores the bias data, based on the image data supplied to the selected at least one pixel row.

10. The display device of claim 9, wherein the bias data is configured such that the bias voltage is supplied to the first group pixels during the bias period.

11. The display device of claim 8, wherein the timing controller supplies a start signal to each of the at least one scan driver.

12. The display device of claim 11, wherein, at a start time of the bias period, the timing controller supplies the start signal to a scan driver coupled to the selected at least one pixel row.

13. The display device of claim 12, wherein, at a start time of a reset period after the bias period, the timing controller supplies the start signal to the scan driver coupled to the selected at least one pixel row, and re-supplies the image data supplied during the display periods to the data driver.

14. A display device comprising:

pixels coupled to scan lines and data lines;

at least one scan driver configured to supply a scan signal to the pixels through the scan lines; and a data driver configured to supply a data signal and a bias signal to the pixels through the data lines, wherein the pixels are supplied with the data signal when the scan signal is supplied during display periods, and are supplied with the bias signal when the scan signal is supplied during a bias period between the display periods, wherein, by the bias signal, a bias voltage is supplied to first group pixels that emit light no more or less than a preset grayscale, or a black grayscale, during the display periods, the first group pixels corresponding to at least one pixel column, and wherein the bias signal is supplied with respect to at least one pixel row selected during the display periods.

15. The display device of claim 14, further comprising a timing controller configured to supply a start signal to each of the at least one scan driver.

16. The display device of claim 15, wherein, at a start time of the bias period, the timing controller supplies the start signal to a scan driver coupled to the at least one selected pixel row.

17. The display device of claim 16, wherein, by the bias signal, a bias voltage is supplied to first group pixels that emit light with no more or less than a preset grayscale, or a black grayscale, during the display periods on the at least one selected pixel row.

18. The display device of claim 17, wherein, by the bias signal, any one of a voltage lower than the bias voltage, the same voltage as that supplied by the data signal, and the bias voltage is supplied to second group pixels that do not emit light with exceeding or no less than the preset grayscale, or a grayscale that is not the black grayscale, during the display periods.

19. The display device of claim 17, wherein, at a start time of a reset period after the bias period, the timing controller supplies the start signal to the scan driver coupled to the at least one selected pixel row, and re-supplies image data supplied during the display periods to the data driver.

20. A display device comprising:

pixels coupled to scan lines and data lines;

first through nth scan drivers configured to supply scan signals to the pixels through the scan lines;

a data driver configured to supply data signals and a bias signal to the pixels through the data lines; and a timing controller configured to supply image data and bias data to the data driver, and to sequentially supply first through nth start signals to the first through nth scan drivers, respectively, wherein the pixels are supplied with the data signals when the scan signals are supplied during display periods, and are supplied with the bias signal when the scan signals are supplied during a bias period between the display periods, wherein, by the bias signal, a bias voltage is supplied to first group pixels that emit light no more or less than a preset grayscale, or a black grayscale, during the display periods, the first group pixels corresponding to at least one pixel column, and wherein n is a natural number greater than one.

* * * * *